US008139781B2

(12) United States Patent
Cheng et al.

(10) Patent No.: US 8,139,781 B2
(45) Date of Patent: Mar. 20, 2012

(54) BLUETOOTH HEADSET WITH A RETRACTABLE STRUCTURE

(75) Inventors: Chi-Hsiang Cheng, Taipei County (TW); Shu-Yuan Cheng, Taipei (TW); Liang-Yi Liu, Taipei (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 465 days.

(21) Appl. No.: 12/371,626

(22) Filed: Feb. 16, 2009

(65) Prior Publication Data

US 2010/0150371 A1 Jun. 17, 2010

(30) Foreign Application Priority Data

Dec. 11, 2008 (CN) ..... 2008 1 0219983

(51) Int. Cl.
*H04R 1/10* (2006.01)

(52) U.S. Cl. ..... 381/74; 381/375; 381/381

(58) Field of Classification Search ..... 381/74, 381/370, 375, 381; 439/131; 455/569.1, 455/575.4, 575.6
See application file for complete search history.

(56) References Cited

U.S. PATENT DOCUMENTS

| | | | | |
|---|---|---|---|---|
| 6,979,210 | B2 * | 12/2005 | Regen et al. | 439/131 |
| 7,020,300 | B1 * | 3/2006 | Villaverde | 381/375 |
| 7,530,823 | B1 * | 5/2009 | Thornton et al. | 439/136 |
| 2006/0025074 | A1 * | 2/2006 | Liang et al. | 455/41.2 |
| 2007/0072649 | A1 * | 3/2007 | Park | 455/569.1 |

FOREIGN PATENT DOCUMENTS

WO WO 2009155784 A1 * 12/2009

* cited by examiner

*Primary Examiner* — Kevin M Picardat
(74) *Attorney, Agent, or Firm* — Li&Cai Intellectual Property (USA) Office

(57) ABSTRACT

A Bluetooth headset includes a case, a circuit board, a speaker, a USB plug, a memory slot, an actuating structure, and a movable lid. The case is a hollow structure. A containing space in the case is accessible to an opening of the case. The circuit board is installed in the containing space. The speaker is installed on the case and electrically connected to the circuit board. Both the USB plug and the memory slot are electrically connected to the circuit board. The actuating structure is disposed on the case for driving the circuit board to selectively move the USB plug and the memory slot toward or away from the opening of the case. The movable lid is disposed at a side of the opening of the case in a rotatable manner.

13 Claims, 4 Drawing Sheets

BLUETOOTH HEADSET WITH A RETRACTABLE STRUCTURE

BACKGROUND OF THE INVENTION

1. Field of the Invention

The present invention relates to a Bluetooth headset, and more specifically, to a Bluetooth headset with a retractable structure.

2. Description of the Prior Art

With development of communication technology, wireless communication (e.g. Bluetooth, WiFi, etc.) is used widely in daily life. As a result, many signal transmission designs are changed from substantial wired connection to wireless connection. A Bluetooth headset is one of the most representative examples.

A Bluetooth headset may be utilized for transmitting audio signals wirelessly through Bluetooth wireless communication technology. In other words, a user just needs to clip the Bluetooth headset onto his ear to receive audio signals (e.g. answering the phone, listening to music, etc.) within Bluetooth communication range (10 m to 100 m). Thus, instead of limited mobility dictated by length of a headset cord, the user has unlimited mobility within the Bluetooth communication range. As mentioned above, a Bluetooth headset may perform audio transmission wirelessly. However, the Bluetooth headset is typically powered by a battery, and thus requires an external power cord for connecting to a power supply to recharge when power of the Bluetooth headset is insufficient. This presents great inconvenience to the user when recharging the Bluetooth headset if the user is not carrying a corresponding power cord.

Furthermore, in general, the Bluetooth headset usually has a built-in memory unit for allowing the user to execute data reading or writing operations, such as recording to/from the phone, or playing back a recording. However, limited storage space of the built-in memory unit usually does not meet the user's needs for data storage.

SUMMARY OF THE INVENTION

The present invention provides a Bluetooth headset with a retractable structure comprising a case, which is a hollow structure, having an opening and a containing space, the opening being accessible to the containing space; a circuit board installed in the containing space; a speaker installed on the case and electrically connected to the circuit board; a USB (Universal Serial Bus) plug electrically connected to the circuit board; a memory slot electrically connected to the circuit board; an actuating structure disposed on the case for driving the circuit board to selectively move the USB plug and the memory slot toward or away from the opening of the case; and a movable lid disposed at a side of the opening of the case in a rotatable manner.

These and other objectives of the present invention will no doubt become obvious to those of ordinary skill in the art after reading the following detailed description of the preferred embodiment that is illustrated in the various figures and drawings.

DETAILED DESCRIPTION

All headset structural designs mentioned in embodiments of the present invention may be applied to a commonly-used headset, such as an ear-hook headset, a Bluetooth headset, etc. In the following, a Bluetooth headset is taken as an example for detailed description of the present invention.

Figure 1:
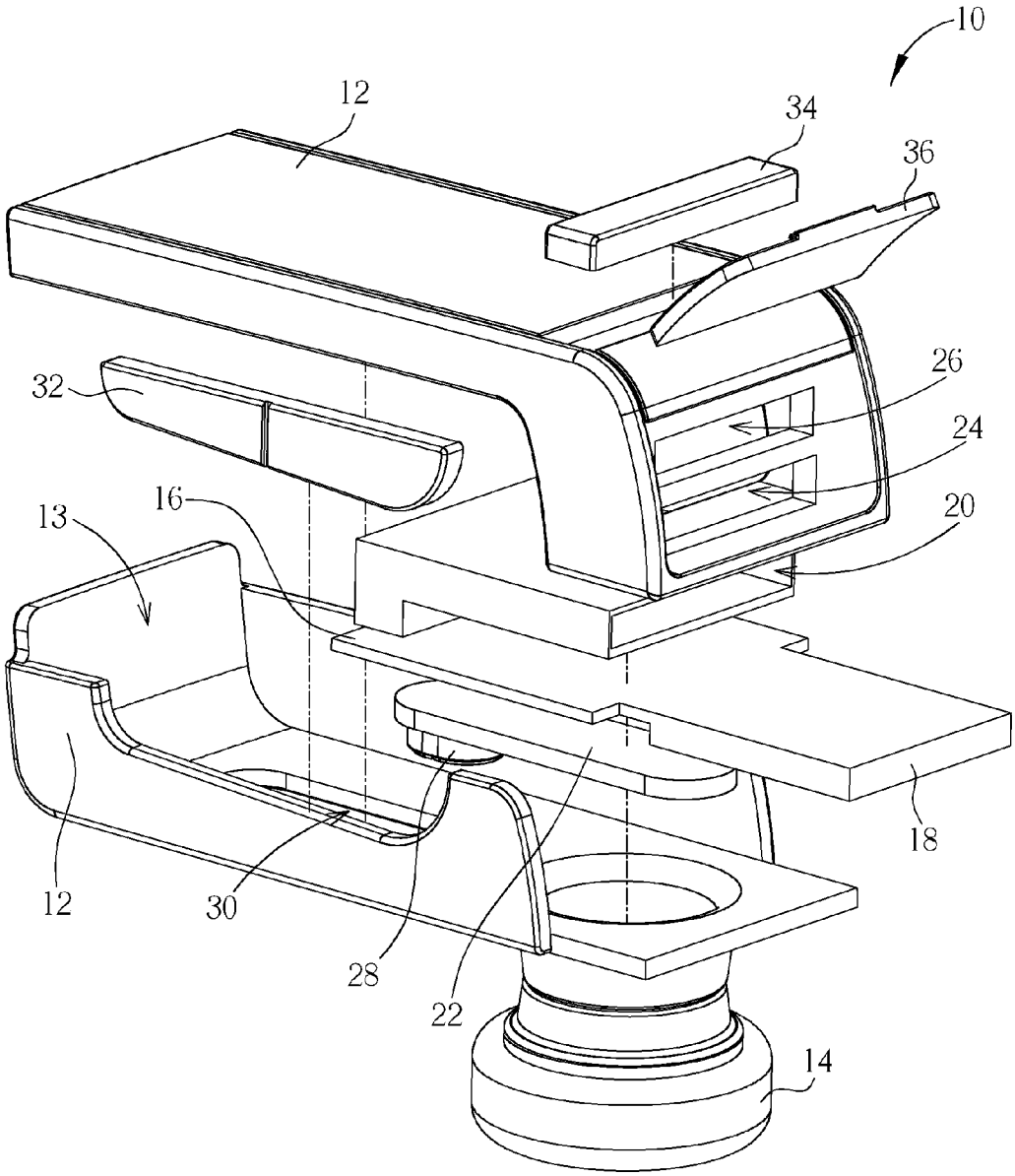
FIG. 1 is an exploded diagram of a Bluetooth headset according to a preferred embodiment of the present invention.

Please refer to FIG. 1, which is an exploded diagram of a Bluetooth headset 10 according to a preferred embodiment of the present invention. The Bluetooth headset 10 comprises a case 12, a speaker 14, a circuit board 16, a USB (Universal Serial Bus) plug 18, a memory slot 20, and an actuating structure 22.

The case 12 is a hollow structure. A containing space 13 in the case 12 is accessible to a first opening 24 and a second opening 26 of the case 12. The first opening 24 is preferably parallel to the second opening 26. Furthermore, structural designs of the first opening 24 and the second opening 26 are not limited to the structure shown in FIG. 1. For example, the first opening 24 and the second opening 26 may be combined into one single opening for reducing manufacturing cost. The circuit board 16 is installed in the containing space 13 in the case 12. The speaker 14 is installed on the case 12 and is electrically connected to the circuit board 16. The speaker 14 is used for transforming electric signals into audio signals. Both the USB plug 18 and the memory slot 20 are selectively contained in the containing space 13 in the case 12. The actuating structure 22 is disposed on the case 12 and is connected to a side of the circuit board 16. The actuating structure 22 is used for moving the circuit board 16 to respectively make the USB plug 18 protrude from the first opening 24 and the memory slot 20 be positioned at the second opening 26, or to make both the USB plug 18 and memory slot 20 be contained in the containing space 13 in the case 12. It should be mentioned that the position of the actuating structure 22 is not limited to a side of the circuit board 16. For example, the actuating structure 22 may also be changed to connect to a side of the USB slot 18. In such a manner, since both the USB plug 18 and the memory plug 20 are electrically connected to the circuit board 16, the circuit board 16 may also move with the USB plug 18 to drive the memory slot 20 to be positioned at the second opening 26 or to be contained in the case 12 correspondingly when the actuating structure 22 moves the USB plug 18 to protrude from the first opening 24 or to be contained in the case 12. In the present invention, which connecting design is utilized depends on practical application. Furthermore, a common connection method may be applied to the connection of the actuating structure 22 and the circuit board 16 or the connection of the actuating structure 22 and the USB plug 18, such as pasting, welding, etc. Next, more detailed description for the actuating structure 22, the circuit board 16, the USB plug 18, and the memory slot 20 is provided as follows in the condition of the actuating structure 22 being connected to the circuit board 16.

As shown in FIG. 1, the actuating structure 22 has a push button 28, and a guide slot 30 is formed on the case 12. The push button 28 may be a narrow slot, and the push button 28 may be a protruding button structure. As mentioned above, the actuating structure 22 is connected to a side of the circuit board 16. Thus, when a user moves the push button 28 along the guide slot 30, the actuating structure 22 may move with the push button 28 to drive the circuit board 16 so that the USB plug 18 and the memory slot 20 may be moved to a corresponding position with the circuit board 16. For example, when the push button 28 is moved to an end of the guide slot 30 close to the first opening 24 and the second opening 26, the USB plug 18 and the memory slot 20 may be moved correspondingly to respectively protrude from the first opening 24 and be positioned at the second opening 26; or, when the push button 28 is moved to an end of the guide slot 30 away from the first opening 24 and the second opening 26, the USB plug 18 and the memory slot 20 may be moved correspondingly to be contained in the containing space 13 in the case 12.

Furthermore, as shown in FIG. 1, the Bluetooth headset 10 further comprises a volume adjusting device 32, a power control device 34, and a movable lid 36. The volume adjusting device 32 is disposed at a side of the case 12. The volume adjusting device 32 is used for adjusting the output power of the speaker 14. A method for adjusting the output power of the speaker 14 is commonly used in the prior art, such as utilizing linkage of a volume switch disposed on a case and a volume adjusting unit disposed on a circuit board for operation of the volume adjusting unit. According to the said example, the volume adjusting device 32 may utilize a two-button adjusting structural design (i.e. one button for volume increase, and another button for volume decrease) shown in FIG. 1. On the other hand, another common structural design for volume adjustment of a headset involves forming a hole on a case for allowing a user to contact and rotate a volume knob (i.e. the volume adjusting device 32) disposed on a circuit board through the hole to adjust the output power of the headset. The power control device 34 is disposed on the case 12. The power control device 34 is used for switching on/off the Bluetooth headset 10. Similarly, a method for switching on/off the Bluetooth headset 10 is commonly used in the prior art, such as utilizing linkage of a power switch structure disposed on a case and a power control unit disposed on a circuit board for switching on/off a Bluetooth headset. According to the said example, the power control device 34 may utilize a button design shown in FIG. 1. On the other hand, another common structural design for switching on/off a Bluetooth headset involves forming a hole on a case for allowing a user to contact and rotate a push power-switch (i.e. the power control device 34) disposed on a circuit board through the hole to switch on/off the Bluetooth headset. As for the movable lid 36, it is pivotally connected to a side of the first opening 24 so that it may rotate relative to the first opening 24 and the second opening 26. In other words, when a user wants to plug the USB plug 18 into a USB port of a computer, the user may push the push button 28 of the actuating structure 22 so that the USB plug 18 may be driven to push the movable lid 36, which covers the first opening 24 and the second opening 26, to rotate upward relative to the case 12. As a result, the USB plug 18 is not covered by the movable lid 36 any more, and then protrudes from the first opening 24 accordingly to make it convenient for the user to plug the USB plug 18 into the USB port of the computer. At this time, the movable lid 36 is supported by the USB plug 18, and still covers the second opening 26. Thus, if the user wants to further use the memory slot 20, the user may need to lift the movable lid 36 to rotate upward relative to the case 12 so that the memory slot 20 may not be covered by the movable lid 36. Subsequently, the user can just insert a storage device (e.g. a memory card) into the memory slot 20 conveniently. Afterwards, if the user has no need to use the USB plug 18 and the memory slot 20, the user may push the push button 28 of the actuating structure 22 to drive the USB plug 18 and the memory slot 20 to move into the containing space 13 of the case 12. At this time, without support of the USB plug 18, the movable lid 36 may rotate downward relative to the case 12 to cover the first opening 24 and the second opening 26 again due to gravity. In such a manner, the Bluetooth headset 10 may utilize the movable lid 36 to prevent dust from entering the case 12 and protect the USB plug 18 and the memory slot 20.

In the prior art, a traditional Bluetooth headset is inconvenient in the areas of data storage and power-recharging for a user due to limited built-in data storage space and necessary external power wired connection. Compared with the prior art, a Bluetooth headset according to the present invention utilizes a structural design combined with a USB plug and a memory slot to increase data transmission convenience and data storage space. Furthermore, a Bluetooth headset according to the present invention further comprises a determining device. The determining device is used for determining connection of a USB plug and a computer and connection of a memory slot and a storage device, and for utilizing corresponding control units to control the USB plug and memory slot to perform power-recharging and data transmission operations of the Bluetooth headset. In the following, more detailed description for internal device design of the Bluetooth headset according to the present invention is provided.

Figure 2:
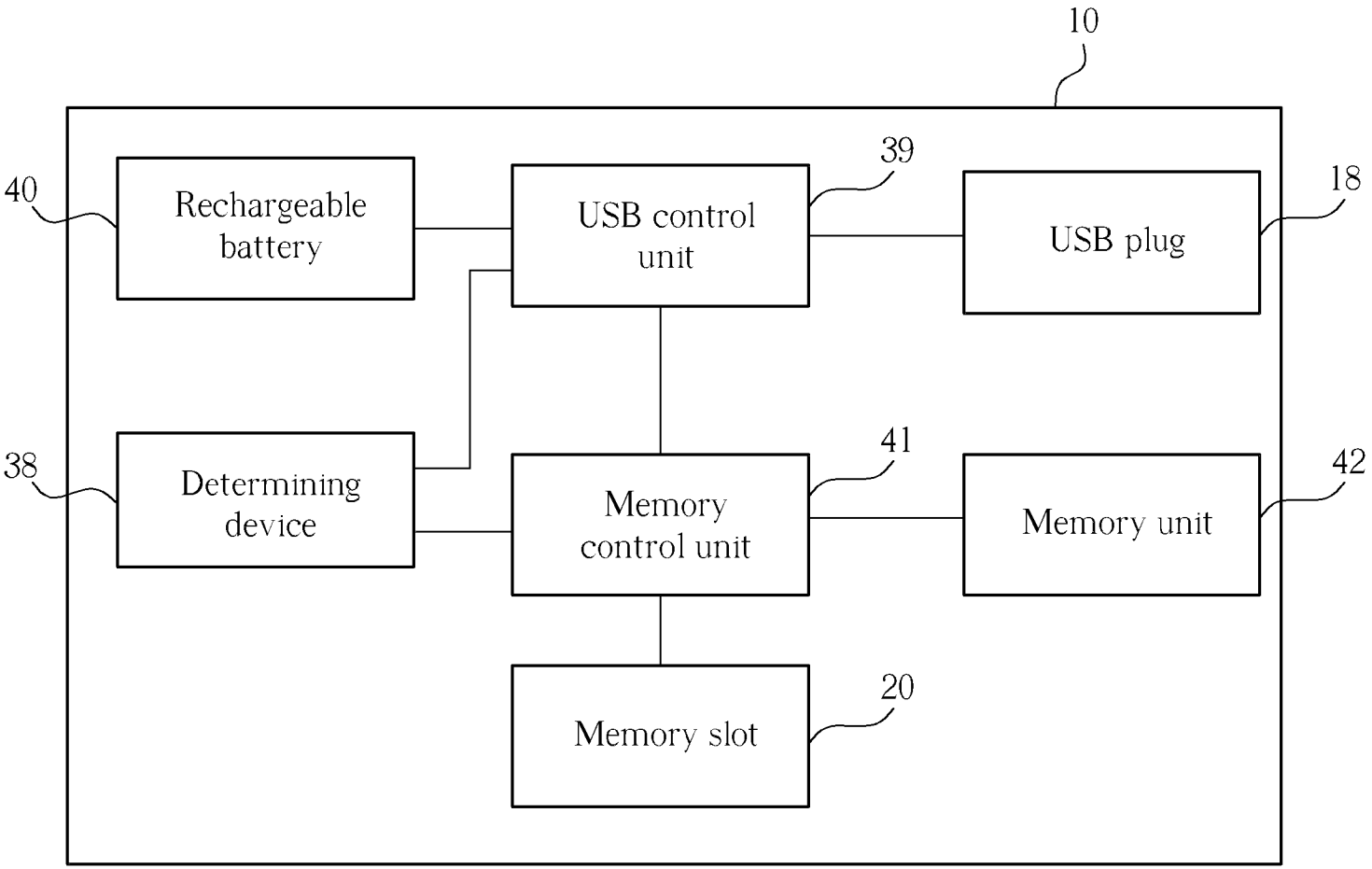
FIG. 2 is a functional block diagram of internal devices in the Bluetooth headset in FIG. 1.

Please refer to FIG. 2, which is a functional block diagram of internal devices in the Bluetooth headset 10 in FIG. 1. As shown in FIG. 2, the Bluetooth headset 10 further comprises a determining device 38, a USB control unit 39, a rechargeable battery 40, a memory control unit 41, and a memory unit 42. The determining device 38 is used for determining whether the USB plug 18 is electrically connected to a computer and the memory slot 20 is electrically connected to a storage device. The USB control unit 39 is electrically connected to the determining device 38, the USB plug 18, and the rechargeable battery 40. The USB control unit 39 may be a common USB control chip built into a motherboard. The determining device 38 may utilize the USB control unit 39 to control power and data transmission of the USB plug 18 when it is determined that the USB plug 18 is electrically connected to a computer through the USB control unit 39. The memory control unit 41 is electrically connected to the memory slot 20, the determining device 38, the USB control unit 39, and the memory unit 42. The memory control unit 41 may be a common memory control chip built into a motherboard. The determining device 38 may utilize the memory control unit 41 to control data transmission of the memory slot 20 when it is determined that the memory slot 20 is electrically connected to a storage device through the memory control unit 41. In the present invention, the determining device 38 may be firmware, hardware, or software which is installed on the circuit board 16. In such a manner, when the determining device 38 determines that the USB plug 18 is electrically connected to a computer through the USB control unit 39, the determining device 38 may utilize the USB control unit 39 to control the rechargeable battery 40 to receive power transmitted from the computer through the USB plug 18 for performing power-recharging of the Bluetooth headset 10. On the other hand, when the determining device 38 determines that the memory slot 20 is electrically connected to a storage device through the memory control unit 41, the determining device 38 may utilize the memory control unit 41 to control the memory unit 42 to perform data transmission between the memory unit 42 and the storage device through the memory slot 20. Furthermore, when the determining device 38 determines that the USB plug 18 is electrically connected to a computer through the USB control unit 39, the determining device 38 may also utilize the USB control unit 39 and the memory control unit 41 to perform data transmission between the memory unit 42 and the computer through the USB plug 18. Similarly, when the determining device 38 determines that the memory slot 20 is electrically connected to a storage device and the USB plug 18 is electrically connected to a computer, the determining device 38 may utilize the memory control unit 41 and the USB control unit 39 to control the memory slot 20 and the USB plug 18 to perform data transmission between the storage device and the computer.

Figure 3:
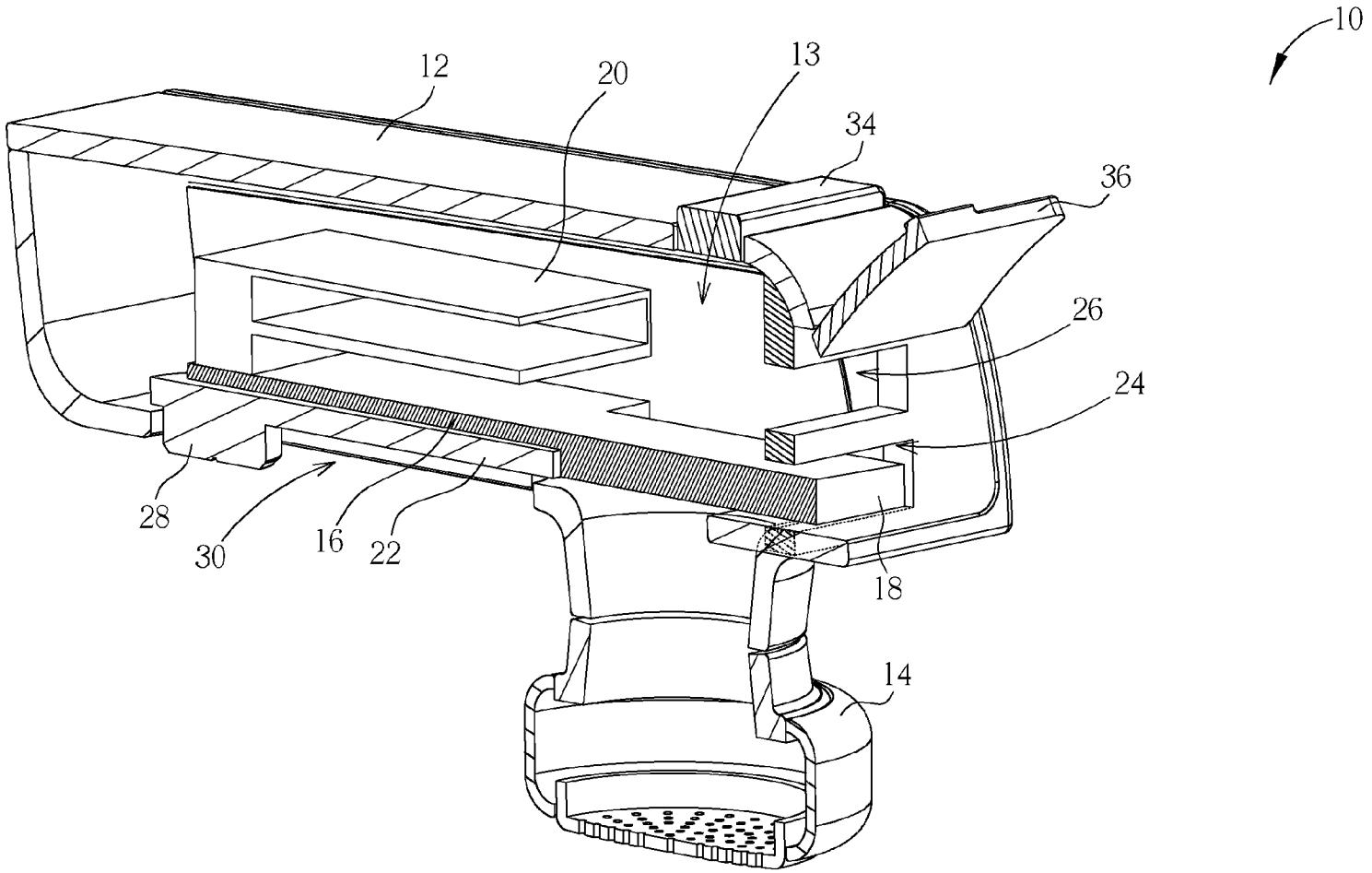
FIG. 3 is a cross-sectional diagram of the USB plug and the memory slot in FIG. 1 being contained in the case.

Next, more detailed description for the operations of the Bluetooth headset 10 is provided as follows. Please refer to FIG. 3, which is a cross-sectional diagram of the USB plug 18 and the memory slot 20 in FIG. 1 being contained in the case 12. When the user has no need to use the USB plug 18 and the memory slot 20, the user may push the push button 28 of the actuating structure 22 along the guide slot 30 of the case 12 to move away from the first opening 24 and the second opening 26. As mentioned above, the USB plug 18 and the memory slot 20 may also be moved into the case 12 at the same time so as to be contained in the containing space 13 of the case 12 (as shown in FIG. 3) since both the USB plug 18 and the memory slot 20 are connected to the circuit board 16 and the actuating structure 22 is connected to a side of the circuit board 16. At this time, without support of the USB plug 18, the movable lid 36 may rotate downward relative to the case 12 to cover the first opening 24 and the second opening 26 again due to gravity. As a result, the movable lid 36 may be utilized to prevent dust from entering the case 12 and protect the USB plug 18 and the memory slot 20.

Figure 4:
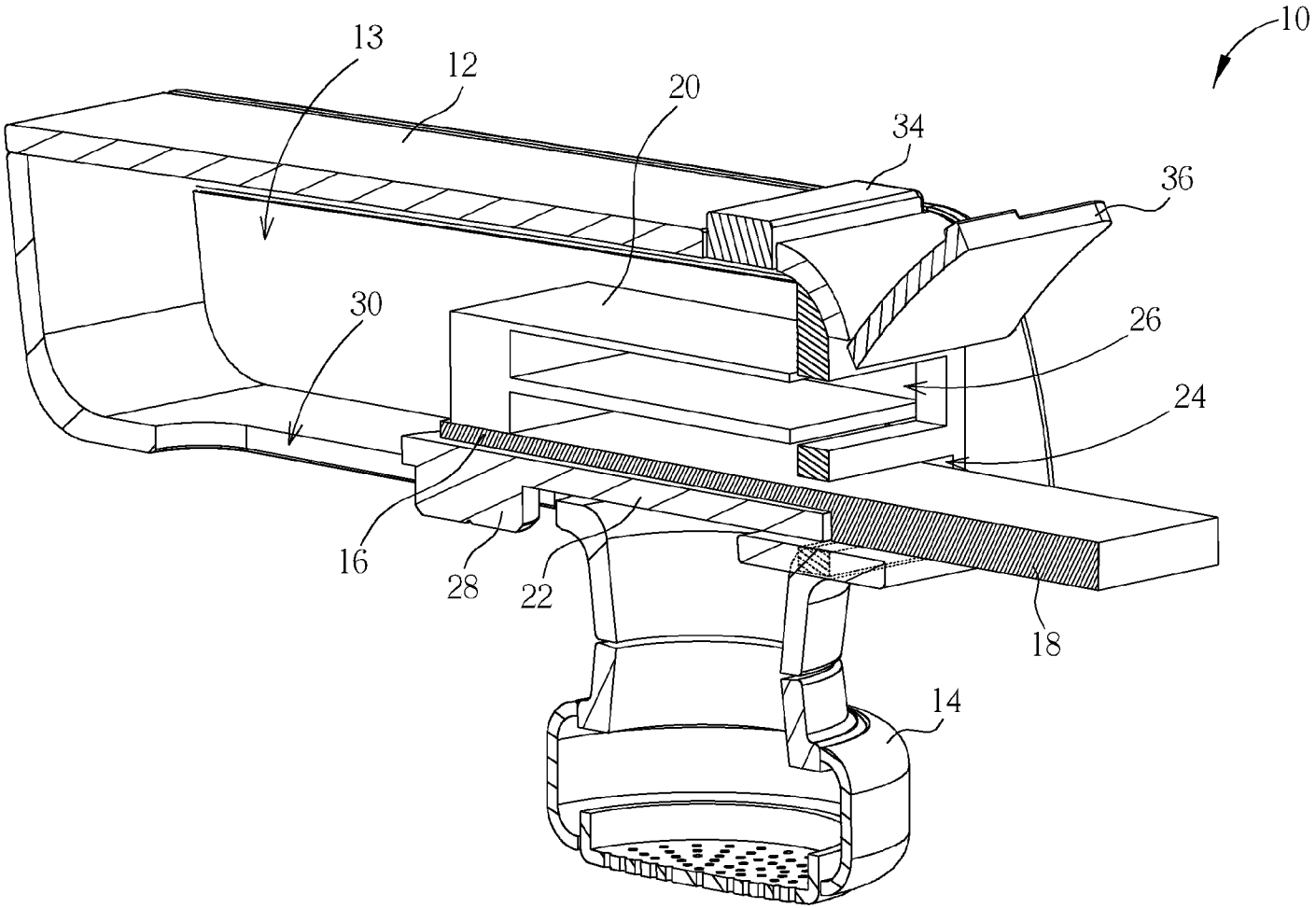
FIG. 4 is a cross-sectional diagram of the USB plug in FIG. 1 protruding from the first opening and the memory slot in FIG. 1 being positioned at the second opening.

Next, please refer to FIG. 2 and FIG. 4 at the same time. FIG. 4 is a cross-sectional diagram of the USB plug 18 in FIG. 1 protruding from the first opening 24 and the memory slot 20 in FIG. 1 being positioned at the second opening 26. When the user wants to use the USB plug 18 or the memory slot 20 again, the user needs to push the push button 28 of the actuating structure 22 along the guide slot 30 of the case 12 to drive the actuating structure 22 to approach the first opening 24 and the second opening 26. As mentioned above, the USB plug 18 and the memory slot 20 may also approach the first opening 24 and the second opening 26 at the same time so as to respectively protrude from the first opening 24 and be positioned at the second opening 26 (as shown in FIG. 4) since both the USB plug 18 and the memory slot 20 are connected to the circuit board 16 and the actuating structure 22 is connected to a side of the circuit board 16. Subsequently, the user may use the protruding USB plug 18 to plug into a USB port of a computer for data transmission between the Bluetooth headset 10 and the computer. It should be noted that the movable lid 36 may still cover the second opening 26 even if the movable lid 36 is pushed by the USB plug 18 when the USB plug 18 protrudes from the first opening 24. Thus, if the user wants to further use memory slot 20, the user needs to lift the movable lid 36 upward so that the user can insert a storage device into the memory slot 20.

Next, when the user utilizes the USB plug 18 and the memory slot 20 to perform data transmission or power recharging of the Bluetooth headset 10, the determining device 38 may execute subsequent determining actions. For example, when the user uses the protruding USB plug 18 to plug into a USB port of a computer, the determining device 38 shown in FIG. 2 may determine that the USB plug 18 is electrically connected to the said USB port. At this time, if the Bluetooth headset 10 is not fully charged, the determining device 38 may utilize the USB control unit 39 to control the USB plug 18 to transmit power from the computer to the rechargeable battery 40 for recharging the Bluetooth headset 10. Furthermore, if the user wants to transmit data stored in the memory unit 42 (e.g. phone records, etc.) to the computer or transmit data of the computer to the memory unit 42, the determining device 38 may utilize the USB control unit 39 and the memory control unit 41 to perform data transmission between the memory unit 42 and the computer through the USB plug 18. Similarly, when the user inserts a memory card, which conforms to the specification of the memory slot 20, into the memory slot 20, the determining device 38 may determine that the memory slot 20 is electrically connected to the memory card. At this time, if the user wants to transmit data stored in the memory unit 42 to the memory card or transmit data stored in the memory card to the memory unit 42, the determining device 38 may utilize the memory control unit 42 to perform data transmission between the memory unit 42 and the memory card through the memory slot 20.

Furthermore, if the user connects the USB plug 18 to a computer and inserts a memory card into the memory slot 20 at the same time, the determining device 38 may determine that the memory slot 20 is electrically connected to the memory card and the USB plug 18 is electrically connected to the computer. Then, if necessary, the determining device 38 may utilize the USB control unit 39 and the memory control unit 41 to perform data transmission between the memory card and the computer through the memory slot 20 and the USB plug 18 in turn. That is to say, the user may not only utilize the extra storage space provided by the memory card to expand the data storage space of the Bluetooth headset 10, but may also utilize the Bluetooth headset 10 as a card reader.

Compared with the prior art, in which a Bluetooth headset needs an external power cord for recharging and has limited data storage space, a Bluetooth headset according to the present invention may not only utilize a structural design combined with a USB plug and a memory slot to increase data transmission convenience and data storage space, but may also utilize a retractable actuating structure and a movable lid to protect the USB plug and the memory slot. Besides, structural designs mentioned in the present invention may also be applied to a common headset.

Those skilled in the art will readily observe that numerous modifications and alterations of the device and method may be made while retaining the teachings of the invention.

What is claimed is:

1. A Bluetooth headset with a retractable structure, the Bluetooth headset comprising:

a case, which is a hollow structure, having an opening and a containing space, the opening being accessible to the containing space;

a circuit board installed in the containing space;

a speaker installed on the case and electrically connected to the circuit board;

a USB (Universal Serial Bus) plug electrically connected to the circuit board;

a memory slot electrically connected to the circuit board;

an actuating structure disposed on the case for driving the circuit board to selectively move the USB plug and the memory slot toward or away from the opening of the case; and a movable lid disposed at a side of the opening of the case in a rotatable manner.

2. The Bluetooth headset of claim 1, wherein a guide slot is formed on the case, the actuating structure has a push button, the push button is disposed in the guide slot in a movable manner, the USB plug protrudes from the opening and the memory plug is positioned at the opening when the push button is moved to an end of the guide slot close to the opening along the guide slot to drive the circuit board toward the opening, and both the USB plug and the memory plug are contained in the case when the push button is moved to an end of the guide slot away from the opening along the guide slot to drive the circuit board away from the opening.

3. The Bluetooth headset of claim 2, wherein the guide slot is a narrow slot, and the push button is a protruding button structure.

4. The Bluetooth headset of claim 1 further comprising:

a determining device for determining whether the USB plug is electrically connected to a computer and the memory slot is electrically connected to a storage device.

5. The Bluetooth headset of claim 4 further comprising:

a USB control unit electrically connected to the USB plug and the determining device, the determining device utilizing the USB control unit to control power and data transmission of the USB plug when the determining device determines that the USB plug is electrically connected to the computer through the USB control unit; and a memory control unit electrically connected to the memory slot, the determining device, and the USB control unit, the determining device utilizing the memory control unit to control data transmission of the memory slot when the determining device determines that the memory slot is electrically connected to the storage device through the memory control unit.

6. The Bluetooth headset of claim 5 further comprising:

a rechargeable battery electrically connected to the USB control unit, the determining device utilizing the USB control unit to control the USB plug to transmit power transmitted from the computer to the rechargeable battery when the determining device determines that the USB plug is electrically connected to the computer through the USB control unit.

7. The Bluetooth headset of claim 5 further comprising:

a memory unit electrically connected to the memory control unit, the determining device utilizing the memory control unit to control the memory slot to perform data transmission between the memory unit and the storage device when the determining device determines that the memory slot is electrically connected to the storage device through the memory control unit.

8. The Bluetooth headset of claim 7, wherein the determining device utilizes the USB control unit and the memory control unit to perform data transmission between the memory unit and the computer through the USB plug when the determining device determines that the USB plug is electrically connected to the computer.

9. The Bluetooth headset of claim 5, wherein the determining device utilizes the USB control unit and the memory control unit to perform data transmission between the computer and the storage device through the memory slot and the USB plug when the determining device determines that the memory slot is electrically connected to the storage device and the USB plug is electrically connected to the computer.

10. The Bluetooth headset of claim 1 further comprising:

a volume adjusting device disposed at a side of the case, the volume adjusting device used for adjusting output power of the speaker.

11. The Bluetooth headset of claim 1 further comprising:

a power control device disposed on the case, the power control device used for switching on or switching off the Bluetooth headset.

12. The Bluetooth headset of claim 1, wherein the actuating structure is connected to a side of the circuit board.

13. The Bluetooth headset of claim 1, wherein the actuating structure is connected to a side of the USB plug.

* * * * *